US009360172B2

(12) United States Patent
Ebner et al.

(10) Patent No.: US 9,360,172 B2
(45) Date of Patent: Jun. 7, 2016

(54) ARRANGEMENT FOR EMITTING LIGHT

(75) Inventors: Stephan Ebner, Dornbirn (AT); Patrik Gassner, St. Gerold (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 84 days.

(21) Appl. No.: 14/233,055

(22) PCT Filed: Jul. 18, 2012

(86) PCT No.: PCT/EP2012/064044

§ 371 (c)(1),
(2), (4) Date: Jan. 15, 2014

(87) PCT Pub. No.: WO2013/011045

PCT Pub. Date: Jan. 24, 2013

(65) Prior Publication Data

US 2014/0160756 A1 Jun. 12, 2014

(30) Foreign Application Priority Data

Jul. 19, 2011 (DE) ..... 10 2011 079 404

(51) Int. Cl.

| | |
|---|---|
| ***F21V 3/00*** | (2015.01) |
| ***F21V 5/00*** | (2015.01) |
| ***F21K 99/00*** | (2016.01) |
| ***F21V 13/04*** | (2006.01) |
| ***G09F 13/04*** | (2006.01) |
| *F21Y 101/02* | (2006.01) |
| *F21Y 103/00* | (2016.01) |

(52) U.S. Cl.

CPC ... *F21K 9/50* (2013.01); *F21S 4/28* (2016.01); *F21V 5/007* (2013.01); *F21V 13/04* (2013.01); *G09F 13/04* (2013.01); *F21Y 2101/02* (2013.01); *F21Y 2103/003* (2013.01)

(58) Field of Classification Search

CPC . F21K 9/50; F21S 4/008; F21V 5/007–5/008; F21V 13/02–13/04; G09F 13/04; G09F 13/18; G09F 2013/049; G09F 2013/1831; G09F 2013/184; G09F 2013/222

USPC ..... 362/240, 245–246, 249.02, 298–300, 362/307–310, 311.02

See application file for complete search history.

(56) References Cited

U.S. PATENT DOCUMENTS

| | | | |
|---|---|---|---|
| 2,215,900 | A | 9/1940 | Bitner |
| 2,254,962 | A | 9/1941 | Harris et al. |

(Continued)

FOREIGN PATENT DOCUMENTS

| | | |
|---|---|---|
| CN | 101324317 | 12/2008 |
| DE | 29915907 | 12/1999 |

(Continued)

OTHER PUBLICATIONS

Machine Translation of JP 2008221530 A to Oshima Denki Co Sep. 25, 2008, 19 Pages.

(Continued)

*Primary Examiner* — Jason Moon Han

(74) *Attorney, Agent, or Firm* — Brooks Kushman P.C.

(57) ABSTRACT

An arrangement for emitting light comprising at least one LED-light source and at least one lens arranged in front of the LED light source in the light-emitting direction. A reflector is arranged in front of the lens in the light emitting direction for influencing the light emitted from the lens.

8 Claims, 2 Drawing Sheets

(56) References Cited

U.S. PATENT DOCUMENTS

| | | | |
|---|---|---|---|
| 5,485,317 | A | 1/1996 | Perissinotto et al. |
| 6,170,971 | B1 | 1/2001 | Godbillon |
| 6,536,923 | B1 | 3/2003 | Merz |
| 6,554,451 | B1 | 4/2003 | Keuper |
| 6,724,543 | B1 | 4/2004 | Chinniah et al. |
| 6,945,674 | B2 | 9/2005 | Yoneda et al. |
| 7,349,163 | B2 | 3/2008 | Angelini et al. |
| 7,438,444 | B2 | 10/2008 | Pao et al. |
| 7,674,018 | B2 | 3/2010 | Holder et al. |
| 7,766,509 | B1 | 8/2010 | Laporte |
| 7,837,349 | B2 | 11/2010 | Chinniah et al. |
| 7,918,583 | B2 | 4/2011 | Chakmakjian et al. |
| 8,007,140 | B2 | 8/2011 | Zhang |
| 8,025,429 | B2 | 9/2011 | Ho et al. |
| 8,235,547 | B2 | 8/2012 | Hofmann |
| 8,251,550 | B2 | 8/2012 | Lai |
| 8,348,475 | B2 | 1/2013 | Wilcox et al. |
| 2005/0094393 | A1 | 5/2005 | Czajkowski |
| 2005/0135106 | A1 | 6/2005 | Kittelmann et al. |
| 2006/0050528 | A1 | 3/2006 | Lyons et al. |
| 2006/0083016 | A1 | 4/2006 | Okamura et al. |
| 2006/0083023 | A1 | 4/2006 | Ayabe et al. |
| 2006/0091414 | A1 | 5/2006 | Ouderkirk et al. |
| 2006/0146531 | A1 | 7/2006 | Reo et al. |
| 2006/0268556 | A1 | 11/2006 | Hsieh |
| 2007/0195534 | A1 | 8/2007 | Ha et al. |
| 2007/0201225 | A1 | 8/2007 | Holder et al. |
| 2009/0046468 | A1 | 2/2009 | Wang et al. |
| 2009/0225543 | A1 | 9/2009 | Jacobson et al. |
| 2009/0323330 | A1 | 12/2009 | Gordin et al. |
| 2010/0038657 | A1 | 2/2010 | Higuchi et al. |
| 2010/0073938 | A1 | 3/2010 | Ho |
| 2010/0195330 | A1 | 8/2010 | Schaefer et al. |
| 2010/0284194 | A1 | 11/2010 | Miyashita et al. |
| 2010/0295071 | A1 | 11/2010 | Tsai et al. |
| 2011/0063857 | A1 | 3/2011 | Li et al. |
| 2011/0096533 | A1 | 4/2011 | Sekela et al. |
| 2011/0103051 | A1 | 5/2011 | Wilcox et al. |
| 2011/0103070 | A1 | 5/2011 | Zhang et al. |
| 2011/0156584 | A1 | 6/2011 | Kim |
| 2012/0307504 | A1 | 12/2012 | Chou |
| 2014/0355273 | A1 | 12/2014 | Saito |

FOREIGN PATENT DOCUMENTS

| | | |
|---|---|---|
| DE | 10025647 | 11/2001 |
| DE | 10314357 | 10/2004 |
| DE | 102007054206 | 4/2009 |
| DE | 102009017424 | 10/2010 |
| DE | 202009007292 | 10/2010 |
| DE | 102010003805 | 10/2011 |
| DE | 102010014209 | 10/2011 |
| EP | 0635744 | 1/1995 |
| EP | 1382960 | 1/2004 |
| EP | 1548356 | 6/2005 |
| EP | 1890076 | 2/2008 |
| EP | 1998105 | 12/2008 |
| EP | 2039985 | 3/2009 |
| JP | 0737401 | 2/1995 |
| JP | 2005093622 | 4/2005 |
| JP | 2008221530 | 9/2008 |
| WO | 9833007 | 7/1998 |
| WO | 0116524 | 3/2001 |
| WO | 2007088665 | 8/2007 |
| WO | 2011015113 | 2/2011 |
| WO | 2011027267 | 3/2011 |

OTHER PUBLICATIONS

International Search Report for PCT/EP2012/064044, English translation attached to original, Both completed by the European Patent Office on Jan. 31, 2013, All together 7 Pages.

Supplemental European Search Report for EP 06746894, Completed by the European Patent Office on Sep. 25, 2009, 2 Pages.

ARRANGEMENT FOR EMITTING LIGHT

CROSS-REFERENCE TO RELATED APPLICATION

This application is the U.S. national phase of PCT Application No. PCT/EP12/064044 filed on Jul. 18, 2012, which claims priority to German Patent Application No. 10 2011 079 404.2 filed on Jul. 19, 2011, the disclosures of which are incorporated in their entirety by reference herein.

The present invention relates to an arrangement for emitting light comprising at least one LED light source and at least one lens arranged in front of the LED light source in the light emission direction.

In the case of elongate luminaires or arrangements for emitting light used in the commercial sector, for example, heretofore fluorescent lamps have often been used as the light source. The advancing development of LEDs now has the consequence more and more that e.g. fluorescent lamps are being replaced by corresponding LEDs. This arises firstly from the fact that LED light sources have considerable advantages regarding lifetime and energy efficiency in comparison with conventional illuminants. Secondly, the light intensities achievable with the aid of LEDs have in the meantime become high enough, such that LED light sources can readily replace traditional light sources such as fluorescent lamps, for example.

In order, then, to achieve a desired emission characteristic of the entire arrangement, provision is made, for example, for lenses to be assigned to the LED light sources, said lenses being arranged in front of the LED light sources in the emission direction. A plurality of such lenses are joined together in this case to form an elongate optical element, wherein preferably in each case exactly one lens of the optical element is assigned to each LED light source. Three differently configured optical elements 2 are shown then in FIG. 1. Such optical elements 2 are in this case usually produced by the injection-molding method.

Two possible light intensity distribution curves of the lenses 6 shown in FIG. 1 are evident from FIGS. 2 and 4, wherein the curves illustrated therein correspond to the values in the C0/C180 plane, that is to say in the transverse direction with respect to the optical elements 2 shown in FIG. 1. The light intensity distribution curve shown in FIG. 2 has two mutually separate wings which in each case have a peak region at 30° and flank regions adjacent thereto on both sides, in which flank regions the light intensity falls to a significantly lower value than in the peak region, wherein one of the flanks falls toward the angular range around 0°. Such a light intensity distribution is advantageous e.g. when a corresponding arrangement for emitting light is arranged along an aisle having shelves in each case on the right and left, which shelves are intended to be correspondingly illuminated by the arrangement for emitting light.

FIG. 3 then shows such an arrangement for emitting light 1 having a housing 3 having a light exit opening, wherein the LED light sources 4 are arranged in the housing 3 and the lenses 6 joined together to form the optical element 2 close the housing 3 in the light emission direction. In the case of the variant shown in FIG. 3, the lenses 6 generate a somewhat different light intensity distribution curve in comparison with FIG. 2, said curve being shown in FIG. 4. A very wide illumination of the region below the arrangement for emitting light 1 is achieved as a result of this.

Overall, there is the problem here, then, that a simple variation of the light intensity distribution or light emission characteristic of the lenses is not readily possible in this way, since a corresponding change heretofore has necessitated exchanging the entire optical element, thereby causing corresponding high costs. In addition, considerable costs also arise as a result of the production of further optical elements by the injection-molding method, since dedicated tools or molds have to be produced for each alternative embodiment, which leads to high costs.

Accordingly, the present invention is based on the object of further developing the arrangement for emitting light outlined above in such a way that the light intensity distribution or light emission characteristic of the arrangement for emitting light can be varied, without the lenses or the optical element being exchanged.

The object is achieved by means of an arrangement for emitting light as claimed in claim 1. The dependent claims relate to advantageous developments of the invention.

The invention proposes an arrangement for emitting light, comprising at least one LED light source and at least one lens arranged in front of the LED light source in the light emission direction, wherein a reflector for influencing the light emitted from the lens is arranged in front of the lens in the light emission direction.

The reflector now makes it possible to vary the light intensity distribution or light emission characteristic of the lens correspondingly, as a result of which one and the same form of lens can be used for a wide variety of lighting tasks. In this case, the reflector is used in particular in the transverse direction. However, there is also the possibility of influencing the light emission in the longitudinal direction by means of the reflector, for example in the case of board lighting in classrooms.

As already explained above, here as well provision can be made for the arrangement for emitting light to have a plurality of LED light sources and a plurality of lenses, wherein the lenses are joined together to form an optical element. In addition, provision can also be made for in each case exactly one lens of the optical element to be assigned to each LED light source. Furthermore, provision can likewise be made for the arrangement for emitting light to have a housing having a light exit opening, wherein the at least one LED light source is arranged in the housing and the at least one lens closes the housing in the light emission direction.

In addition, the light intensity distribution curve of the light emitted from the lens in the C0/C180 plane can have one or a plurality of, preferably two substantially symmetrical, mutually separate wings which lie in each case substantially in an angular range of 0° to 90° relative to an axis parallel to the light emission direction through the light centroid of the lens and in each case have a peak region and flank regions adjacent thereto on both sides, in which flank regions the light intensity falls to a significantly lower value than in the peak region, wherein the peak region lies at angles of greater than 0° and one of the flanks falls toward the angular range around 0°.

Furthermore, provision can be made for the reflector to be designed and arranged laterally in front of the lens in such a way that substantially the entire light emitted from the lens is directed to that side of the lens which is situated opposite the reflector. In this case, provision can additionally be made for that side of the reflector which faces away from the lens to be designed as an advertising/information carrier. This configuration and arrangement of the reflector then results in a light intensity distribution or light emission characteristic which, e.g. when the arrangement for emitting light is fitted along an aisle, has the effect that only one side of the aisle is correspondingly illuminated. This could be of interest, for example, if a shelf, which is intended to be correspondingly illuminated, is arranged only on one side of the aisle.

Alternatively, provision can be made for the reflector to be a diaphragm, which is designed and arranged in front of the lens in such a way that the emission angle of the light emitted from the lens is reduced or narrowed, in particular in the C0/C180 plane, wherein the lens can already be designed in such a way that it results in suppression of glare in the C90/C270 plane. Suppression of glare is thereby achieved in the case of a relatively widely emissive lens, as a result of which a corresponding arrangement for emitting light can be used e.g. also at computer workstations or in the checkout region of a store.

Furthermore, provision can be made for a reflector to be assigned to one lens in each case or for a reflector to be assigned to a plurality of lenses, wherein reflectors can also be assigned only to a portion of the lenses.

The invention will be explained in greater detail below on the basis of exemplary embodiments and the accompanying drawings, in which.

Figure 1:
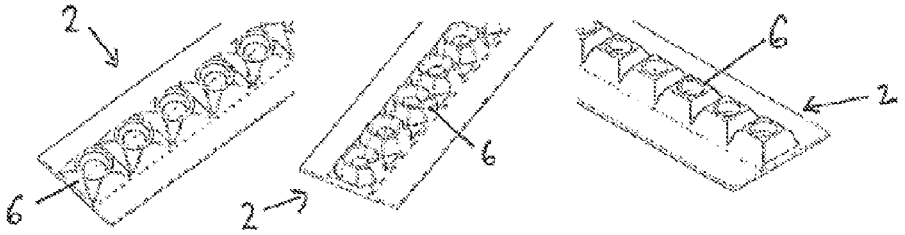
FIG. 1 shows an illustration of a plurality of lenses joined together to form optical elements.
Figure 3:
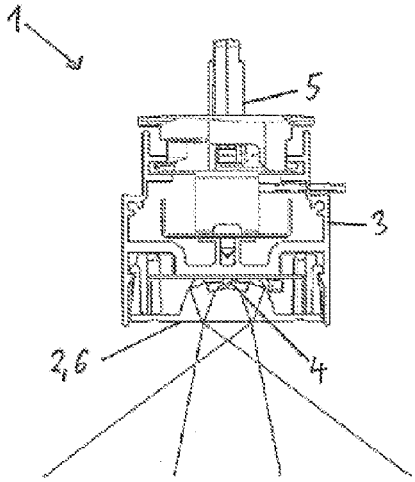
FIG. 3 shows an arrangement for emitting light comprising an optical element having a plurality of lenses.

FIG. 3 shows, as already explained, an arrangement for emitting light 1 known from the prior art. The arrangement for emitting light 1 has a housing 3 having a light exit opening, wherein LED light sources 4 are arranged in the housing and the light exit opening is closed by an optical element 2. In this case, the optical element 2 consists of a plurality of lenses 6 arranged in front of the LED light sources 4 in the light emission direction. Such optical elements 2 composed of a plurality of lenses 6 are shown by way of example in FIG. 1.

Figure 2:
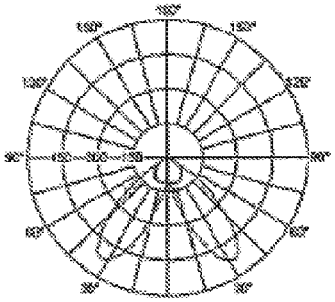
FIG. 2 shows a possible light intensity distribution curve of the lenses shown in FIG. 1 in the transverse direction.
Figure 4:
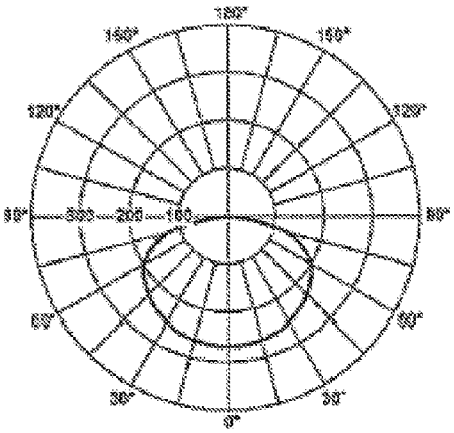
FIG. 4 shows the light intensity distribution curve of the arrangement for emitting light shown in FIG. 3 or of the optical element in the transverse direction.

FIGS. 2 and 4 show two different light emission characteristics or light intensity distribution curves of such lenses 6 in the C0/C180 plane and thus in the transverse direction with respect to the optical element 2. The light intensity distribution curve shown in FIG. 2 is suitable, in particular, e.g. for stores selling merchandise in which shelves are arranged in each case on the left and right along aisles, which shelves are intended particularly to be illuminated by corresponding arrangements for emitting light 1. The light intensity distribution curve shown in FIG. 4, by contrast, is preferred particularly when a relatively large region below such an arrangement for emitting light 1 is intended to be illuminated, since the lenses 6 have a relatively widely emissive characteristic in this case.

Furthermore, in the arrangement for emitting light 1, a device 5 is also provided at the top side of the housing, which device enables the arrangement for emitting light 1 to be mechanically fixed to a supporting rail and furthermore makes contact with lines running within the supporting rail.

Figure 7:
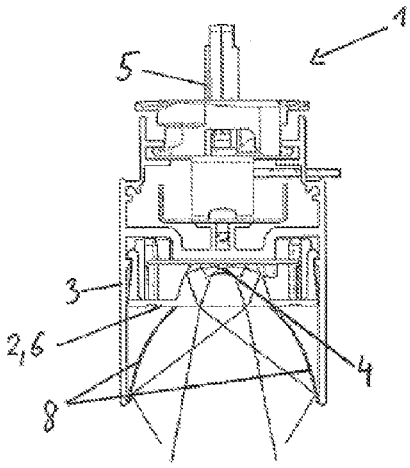
FIG. 7 shows an arrangement for emitting light according to the invention in accordance with a second embodiment.

According to the invention, then, provision is made for a reflector 7, 8 for influencing the emission of light from the lens 6 to be arranged in front of the lens 6 in the light emission direction. In this respect, FIGS. 5 and 7 illustrate two exemplary embodiments according to the invention.

Figure 6:
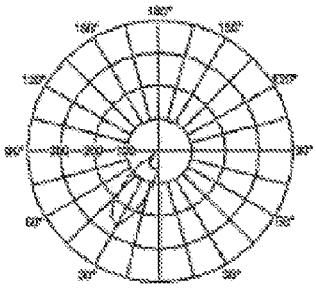
FIG. 6 shows the light intensity distribution curve of the arrangement for emitting light shown in FIG. 5 in the transverse direction.
Figure 5:
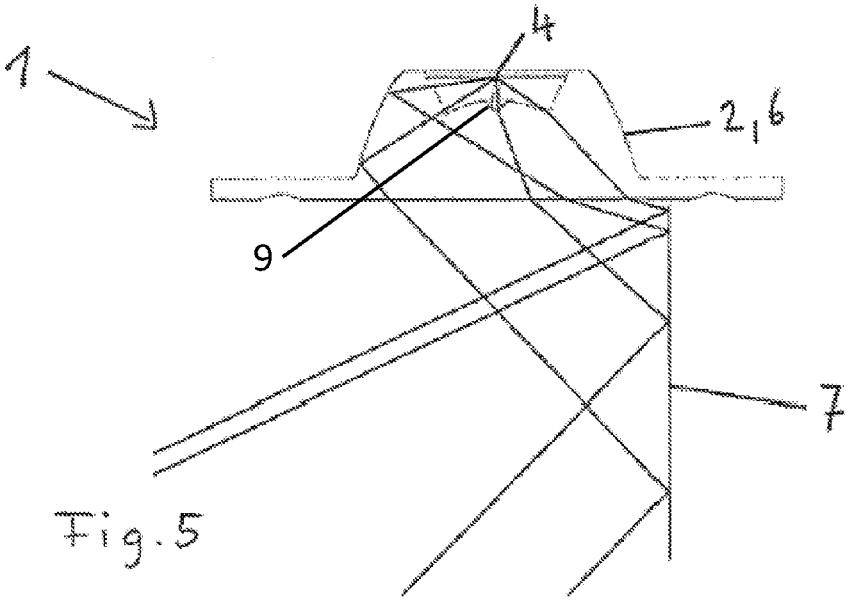
FIG. 5 shows an arrangement for emitting light according to the invention in accordance with a first embodiment.

FIG. 5, then, in this case shows a corresponding configuration variant in which a reflector 7 of substantially flat or planar configuration is arranged at a side of the lens 6 in the longitudinal direction of the arrangement for emitting light 1 or of the optical element 2, as a result of which the light rays emitted through the lens 6 in this direction are reflected or directed in the direction of the opposite side. In this case, the reflector 7 is used, in particular, in the case of lenses 6 having a central recess 9 providing a light intensity distribution curve according to FIG.2. As a result, the light intensity distribution curve shown in FIG.6 then arises, given the corresponding lens 6 and central recess 9 configuration and the arrangement of the reflector 7. It can now clearly be discerned from FIG. 6 that light is now only emitted toward one side, or the light intensity distribution curve now has only one wing, in contrast to the light intensity distribution curve in FIG. 2 having two wings.

Such a configuration is desirable e.g. when shelves are arranged along an aisle only on one side and, accordingly, only this side is actually intended to be illuminated. In this case, however, it is now no longer necessary that the entire optical element 2 must be exchanged in an arrangement for emitting light 1. However, it is readily possible for an arrangement for emitting light 1 to be installed with a corresponding optical element 2, and then for a reflector 7 subsequently to be assigned to the arrangement for emitting light 1 in accordance with the local conditions.

In accordance with the desired light emission characteristic or the light intensity distribution, the reflector can have any desired shapes, e.g. curved. Furthermore, there is also the possibility of the entire light from the lens being directed onto a reflector.

Normally, then, in linear luminaires the main use direction of such reflectors is in the transverse direction. However, there is also the possibility of influencing the light emission in the longitudinal direction by means of reflectors. This is advantageous e.g. in the case of board lighting in classrooms, since it is then no longer necessary here that in the region of the board an individual luminaire has to be suspended transversely with respect to the luminaires arranged in the rest of the room, since the board lighting can then be achieved by means of the specific arrangement of the reflector.

In addition, it can also be provided that, for a sales area, for example, the rear side of a preferably planar or flat reflector can be equipped with advertising/information carriers, the rear side being illuminated by the transversely extending web of the lens.

In contrast to the exemplary embodiment shown in FIG. 5, in which a substantially flat or planar reflector 7 is used, the reflector 8 in the exemplary embodiment shown in FIG. 7 is designed as a diaphragm. In this case, the diaphragm 8 is shaped and positioned in front of the lens 6 in such a way that the emission angle of the light emitted from the lens 6 is reduced or narrowed. In this case, the arrangement for emitting light 1 shown in FIG. 7 otherwise corresponds to the arrangement for emitting light 1 from FIG. 3, the housing 3 here having somewhat longer limbs for accommodating the diaphragm 8.

Figure 8:
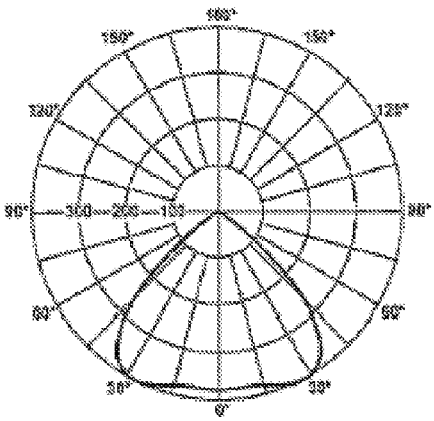
FIG. 8 shows the light intensity distribution of the arrangement for emitting light shown in FIG. 7 in the transverse direction.

This reduction or narrowing of the emission angle of the light emitted from the lens 6 is effected by the diaphragm 8 in this case in particular in the transverse direction of the arrangement for emitting light 1 or of the optical element 2. This can also be gathered from the light emission characteristic or light intensity distribution curve shown in FIG. 8, which has a smaller emission angle in contrast to the light intensity distribution curve shown in FIG. 4, as a result of which, in comparison with the arrangement for emitting light 1 shown in FIG. 3, the suppression of glare is correspondingly optimized by the diaphragm 8.

As a result, it is possible, for example, that a corresponding arrangement for emitting light 1 can also be used in the checkout region of a store selling merchandise, since this arrangement fulfils the corresponding requirements for such a workplace area. Furthermore, use at display workstations, for example, is also possible.

The diaphragm 8 shown in FIG. 7 can, however, also be used together with a lens 6 having a light intensity distribution curve according to FIG. 2.

In FIG. 7, the diaphragm 8 consists of two curved reflective elements fitted to each side, wherein these elements, like the reflector 7 in FIG. 5 as well, are arranged in the longitudinal direction of the arrangement for emitting light 1 or of the optical element 2. In the case of a lens 6 having a light intensity distribution curve according to FIG. 2, in this case each reflective element thus substantially influences one of the two wings, as a result of which a variation of the wings or of the angle between the two wings is achieved.

The diaphragm can, however, also have a correspondingly different form. By way of example, it would also be conceivable for the diaphragm to be configured in such a way that circumferential suppression of glare is realized by means of the diaphragm. In this case, however, it should be taken into consideration that the lenses can already be configured in such a way that suppression of glare in the longitudinal direction is already effected by the lenses.

The diaphragm, too, now in turn makes it possible for a corresponding arrangement for emitting light to be mounted with a corresponding optical element and for the diaphragm to be fitted only afterward, depending on the desire for lighting, as a result of which it becomes possible to use the same or a very small number of different lenses for many different lighting tasks.

The invention claimed is:

1. An elongate luminaire arrangement for emitting light, comprising a plurality of LED light sources and a plurality of lenses arranged after the LED light sources in the light emission direction, wherein a reflector for influencing the light emitted from the lenses is arranged after the lenses in the light emission direction characterized in that, each lens has a recess on the surface where the light emitted by the LED light sources enters the lens to produce a light intensity distribution curve of light emitted from the corresponding lens in the C0/C180 plane having a plurality of mutually separate wings which lie in each case substantially in an angular range of 0° to 90° relative to an axis parallel to the light emission direction through the light centroid of the corresponding lens and in each case have a peak region and flank regions adjacent thereto on both sides, in which flank regions the light intensity falls to a significantly lower value than in the peak region, wherein the peak region lies at angles of greater than 0° and one of the flanks falls toward the angular range around 0°, and in that the lenses are joined together to form an elongate optical element.

2. The arrangement for emitting light as claimed in claim 1, wherein the light intensity distribution curve has two wings which lie substantially symmetrically relative to an axis parallel to the light emission direction through the light centroid of the corresponding lens.

3. The arrangement for emitting light as claimed in claim 1, wherein the reflector is designed and arranged laterally in front of the lenses in such a way that substantially the entire light emitted from the lenses is directed to that side of the lenses which is situated opposite the reflector.

4. The arrangement for emitting light as claimed in claim 3, wherein that side of the reflector which faces away from the lenses is designed as an advertising/information carrier.

5. The arrangement for emitting light as claimed in claim 1, wherein the reflector is a diaphragm, which is designed and arranged in front of the lenses in such a way that the emission angle of the light emitted from the lenses in the C0/C180 plane is reduced or narrowed.

6. The arrangement for emitting light as claimed in claim 1, wherein in each case exactly one lens of the optical element is assigned to each LED light source.

7. The arrangement for emitting light as claimed in claim 1, wherein the reflector is assigned only to a portion of the lenses.

8. The arrangement for emitting light as claimed in claim 1, wherein the arrangement for emitting light has a housing having a light exit opening, wherein the plurality of LED light sources are arranged in the housing and the plurality of lenses close the housing in the light emission direction.

* * * * *